United States Patent [19]

Polney

[11] 3,969,799

[45] July 20, 1976

[54] TURBULENCE GENERATOR FOR YARN TEXTURING AIR JET

[75] Inventor: Richard J. Polney, New Castle, Del.

[73] Assignee: Enterprise Machine and Development Corporation, New Castle, Del.

[22] Filed: May 12, 1975

[21] Appl. No.: 576,296

[52] U.S. Cl. ..... 28/1.4

[51] Int. Cl.[2] ..... D02G 1/16

[58] Field of Search ..... 28/1.4, 72.12; 57/34 B, 57/157 F; 226/7, 97; 302/25, 63

[56] References Cited

UNITED STATES PATENTS

| | | | |
|---|---|---|---|
| 3,380,242 | 4/1968 | Richmond et al. | 28/1.4 X |
| 3,863,309 | 2/1975 | Price | 28/1.4 |
| 3,881,232 | 5/1975 | Price et al. | 28/1.4 |

*Primary Examiner*—Louis K. Rimrodt

*Attorney, Agent, or Firm*—Bell, Seltzer, Park & Gibson

[57] ABSTRACT

This turbulence generator is particularly for use with a yarn texturing air jet of the type having a venturi supported in the exit end of the jet with a yarn guiding needle positioned in the entrance end of the jet and with the space between the venturi and the inner end of the needle defining a turbulence chamber. The turbulence generator is in the form of a tubular extension projecting outwardly beyond the exit end of the needle to increase the size and change the usual shape of the turbulence chamber so that the agitation of the filaments of the yarn is increased in the turbulence chamber to enhance the crimps, curls and loops imparted to the yarn in the turbulence chamber.

9 Claims, 6 Drawing Figures

TURBULENCE GENERATOR FOR YARN TEXTURING AIR JET

This invention relates generally to a yarn texturing air jet and more particularly to a turbulence generator for use in the turbulence chamber of the air jet to enhance the crimps, curls and loops produced in the filaments of the yarn, to permit a faster and more economical operation, and to provide uniform characteristics throughout the length of the yarn.

The present invention is particularly useful with yarn texturing air jets of the type having an elongate housing with a venturi supported in one end and a yarn guiding needle positioned in the other end. The exit end of the needle terminates adjacent the inwardly tapering conical surface on the inner or entrance end of the venturi to define a turbulence chamber between the exit end of the needle and the venturi. The pressurized air usually enters the housing at a right angle and through an inlet located near the center of the housing to create a turbulent yarn texturing chamber or zone between the exit end of the needle and the entrance end of the venturi so that crimps, curls and loops are formed in the filaments of the yarn. In most air jets of this type, the inner or exit end of the needle is substantially flat or square and this restricts the size and shape of the turbulence chamber so that the speed of operation is limited and a limitation is placed on the size and configuration of the crimps, curls and loops which may be formed in the filaments of the yarn. This general type of air jet is disclosed in U.S. Pat. Nos. 3,454,057; 3,381,346; 3,328,843; and 2,994,938.

U.S. Pat. No. 3,863,309 discloses a yarn texturing air jet in which the needle is provided with a conical opening extending from the inner or exit end of the needle and inwardly to the yarn guiding channel so that the normal size and shape of the turbulence chamber is enlarged. This conical opening in the needle does permit a faster and more economical operation and does enhance the crimps, curls and loops formed in the yarn. However, the size of the conical opening is limited by the size of the inner end of the needle and the amount of increase in speed of operation of this type of air jet is therefore limited.

With the foregoing in mind, it is an object of the present invention to provide a turbulence generator for a yarn texturing air jet which permits the yarn to be textured or bulked at a substantial higher speed than heretofore possible, provides a more effective use of the pressurized air, and enhances the crimps, curls and loops imparted to the filaments of the yarn.

In accordance with the present invention, the inner end of the needle of the air jet is provided with a tubular extension, in the form of a sleeve, projecting outwardly beyond the exit end of the needle and having an inner end portion positioned closely adjacent the inwardly tapering conical surface on the inner end of the venturi so that the entrance end of the turbulence chamber is defined by the exit end of the needle and the tubular extension on the inner end of the needle. Thus, the normal size and shape of the turbulence chamber is changed so that the entrance end of the turbulence chamber is enlarged and extended toward the entrance end of the air jet. When the tubular extension is used with a jet needle having a conical opening, as disclosed in U.S. Pat. No. 3,863,309, the size and shape of the turbulence chamber is further enlarged and extended so that the pressurized air passing over the end of the tubular extension forms vortices thereby increasing the agitation in the turbulence chamber and creating pressure drag on the yarn as it passes through the turbulence chamber. This change in the size and shape of the entrance end of the turbulence chamber creates a positive separation of the individual filaments of the yarn to permit the formation of well-defined crimps, curls and loops in the filaments of the yarn.

The sleeve defining the tubular extension of the needle has an inner diameter surrounding and conforming to the outer diameter of the inner end portion of the needle and is provided with means for adjustably supporting the sleeve on the inner end portions of the needle for axial adjustment relative to the exit end of the needle. The sleeve can take various shapes, only four of these are illustrated, with the outer surface thereof being either straight or tapered and with the inner end portion being either straight or tapered inwardly in a conical manner.

Other objects and advantages will appear as the description proceeds when taken in connection with the accompanying drawings, in which.

Figure 1:
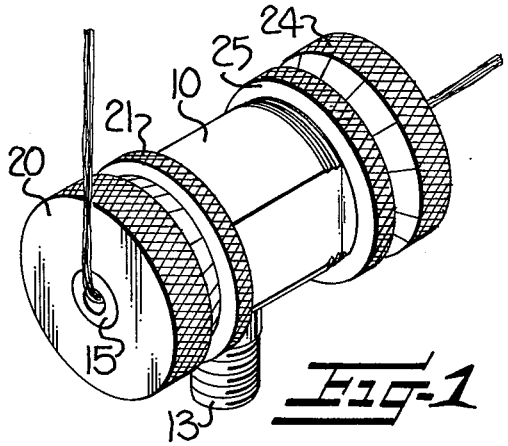
FIG. 1 is an isometric view of a yarn texturing air jet of the general type with which the turbulence generator of the present invention is adapted for use.

The air jet with which the turbulence generator of the present invention is adapted to be used includes an elongate housing 10 having a central bore 11 extending therethrough and from the entrance end to the exit end thereof. The central bore 11 is of the same diameter throughout except that an enlarged groove 12 is provided in the central portion which defines a plenum chamber. Means is provided for directing pressurized air or gas into the plenum chamber and the central bore 11 and includes a threaded inlet nipple 13, the inner end of which is fixed in the housing 10 and the outer end of which is adapted to be connected to any suitable source of pressurized gas or air, not shown.

A venturi 15 is supported for longitudinal adjustment in the central bore 11 and in the exit end of the housing 10. An inwardly tapering conical surface 16 is provided on the inner or entrance end of the venturi 15 and terminates at an exit orifice 17 which extends through and to the outer end of the venturi 15. The inwardly tapering conical surface 16 defines the exit end of the turbulence chamber.

The outer end portion of the venturi 15 is fixed in a venturi cap 20 which is supported on the threaded exit end portion of the housing 10 so that the venturi 15 may be longitudinally adjusted along the central bore 11 by rotation of the venturi cap 20. A lock ring 21 is threadably supported on the threaded exit end of the housing 10 and adjacent the venturi cap 20 so that the venturi 15 may be locked in adjusted position.

A yarn guiding needle 23 is positioned in the central bore 11 of the housing 10 and its outer or entrance end is fixed in a needle support cap 24 which is threadably supported on the threaded entrance end portion of the housing 10 so that the needle 23 may be longitudinally adjusted along the central bore 11 by rotation of the cap 24. A lock ring 25 is threadably supported on the threaded entrance end of the housing 10 and adjacent the cap 24 so that the needle 23 may be locked in adjusted position.

An axial yarn guiding channel 32 extends throughout the length of the needle 23 for directing multifilament yarn through the needle 23 and the venturi 15. The inner or exit end portion of the yarn guiding channel 32 is reduced in diameter, as at 33, and a conical opening 34, of the type illustrated in U.S. Pat. No. 3,863,309, is preferably provided on the inner or exit end of the needle 23. This conical opening 34 extends inwardly toward the entrance end of the needle 23 and terminates at the reduced portion 33 of the axial yarn guiding channel 32 extending through the needle. However, it is to be understood that the turbulence generator of the present invention may be used with a needle having a flat end, without the conical opening 34 therein.

The outer diameter of the inner or exit end portion of the needle 23 may be reduced in diameter and beveled as at 35 so that it tapers inwardly at an angle corresponding to the inwardly tapering conical surface 16 on the inner end of the venturi 15. The conical surface 16 on the inner end of the venturi 15 defines an angle of approximately 30° with the longitudinal axis of the air jet. The beveled outer surface 35 of the inner end of the needle 23 also defines an angle of approximately 30° with the longitudinal axis of the air jet. The turbulence generator of the present invention comprises a tubular extension projecting outwardly beyond the exit end of the needle 23 and having an inner end portion positioned closely adjacent the inwardly tapering conical surface 16 on the inner end of the venturi 15 whereby the entrance end of the turbulence chamber is defined by the exit end of the needle 23 and the tubular extension on the inner end thereof. This tubular extension increases the turbulence in the turbulence chamber, enhances the crimps, curls and loops imparted to the yarn, permits the texturing of yarn at higher speeds than were heretofore possible, and provides uniformity of the texturing and bulking characteristics throughout the length of the textured yarn.

Figure 2:
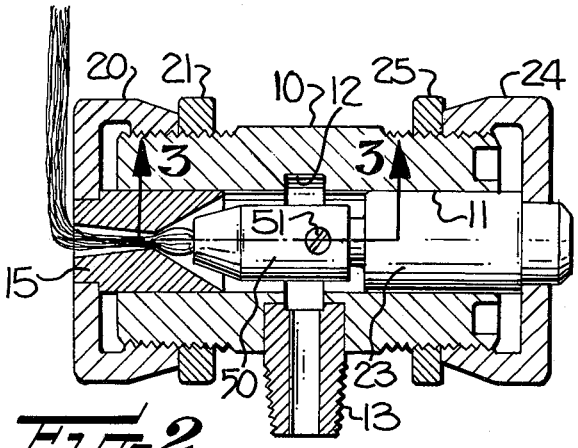
FIG. 2 is an enlarged longitudinal vertical sectional view through the air jet shown in FIG. 1 and illustrating one form of the turbulence generator sleeve attached to the inner end of the needle.
Figure 3:
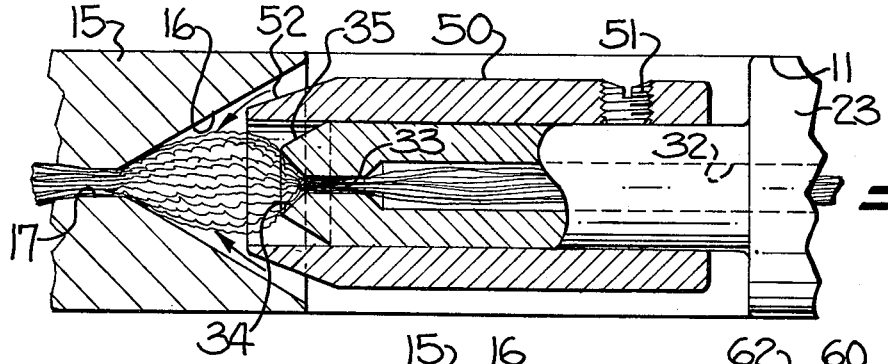
FIG. 3 is a greatly enlarged fragmentary longitudinal sectional view taken substantially along the line 3—3 in FIG. 2 and showing the turbulence generator sleeve in cross-section with a portion of the inner end of the needle being cross-sectioned.

The form of tubular extension illustrated in FIGS. 2 and 3 comprises a sleeve 50 having an inner diameter surrounding and conforming to the outer diameter of the inner end portion of the needle 23. Means is provided for adjustably supporting the sleeve 50 on the inner end portion of the needle 23 for axial adjustment relative to the exit end of the needle. This adjustment means is illustrated in the form of a set screw 51 threadably supported in the sleeve 50 and having an inner end adapted to engage the outer diameter of the inner end portion of the needle 23. The set screw 51 thus permits the sleeve 50 to be adjusted longitudinally on the needle 23 to thereby change the amount that the inner end portion of the sleeve 50 projects outwardly beyond the exit end of the needle 23.

The form of sleeve 50 illustrated in FIGS. 2 and 3 is provided with a conical tapering outer peripheral surface 52 on its end portion adjacent to the inwardly tapering conical surface 16 on the inner end of the venturi 15. This conical outer peripheral surface 52 tapers approximately 15 degrees relative to the axial center of the sleeve 50.

In texturing yarn with the air jet equipped with the tubular extension of the present invention, the pressurized air enters the air jet through the nipple 13, passes into the plenum chamber 12, moves forwardly along the outer periphery of the sleeve 50, between the inwardly tapering conical surface 16 of the venturi 15 and the inner end of the inwardly tapering surface 52 of the sleeve 50, through the turbulence chamber, and outwardly through the exit orifice 17. However, the inner end of the sleeve 50 providing the tubular extension changes the size and shape of the entrance end of the turbulence chamber and causes positive separation of the filaments of the yarn before they clear the exit end of the sleeve 50.

The tubular extension formed by the inner end of the sleeve 50 causes the pressurized air moving over the end thereof to form vortices in the inner diameter of the sleeve 50 and in the conical opening 34 of the needle 23. These vortices tend to cause a positive outward separation of the filaments as they leave the reduced portion 33 of the axial yarn guiding channel 32 and also increase the agitation in the turbulence chamber so as to enhance the crimps, curls and loops imparted to the filaments by the yarn.

The vortices in the inner end of the sleeve 50 and the conical opening 34 at the entrance end of the turbulence chamber also impart a pressure drag to the yarn as it moves through the air jet. Thus, a more efficient use of the air is accomplished in the jet of the present invention than has heretofore been possible with prior art types of air jets in which the inner or exit end of the needle is flat. A more efficient use of the air is also accomplished in prior types of air jets, such as is illustrated in U.S. Pat. No. 3,863,309, wherein the inner or exit end of the needle is provided with a conical opening.

It is to be understood that the size and shape of the turbulence chamber may be increased or decreased by correspondingly adjusting the longitudinal position of the needle 23. The size and shape of the turbulence chamber may also be changed by adjusting the longitudinal position of the sleeve 50 on the needle 23.

Figure 4:
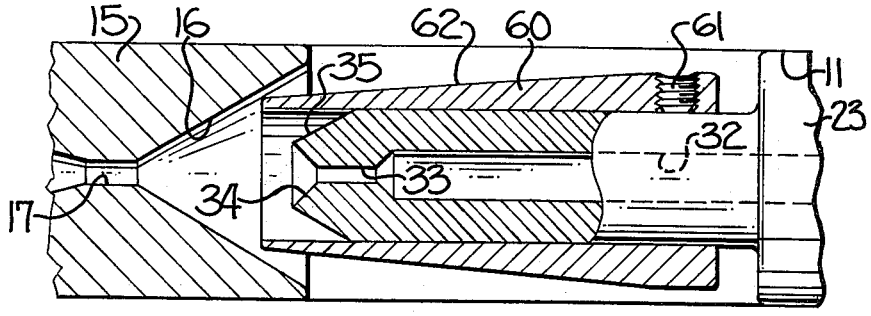
FIG. 4 is a view similar to FIG. 3 but illustrating a second form of turbulence generator sleeve applied to the inner end of the needle.

The second type of turbulence generator sleeve, indicated at 60 in FIG. 4, also includes an inner end portion positioned closely adjacent the inwardly tapering conical surface 16 on the inner end of the venturi 15 so that the entrance end of the turbulence chamber is defined by the exit end of the needle 23 and the tubular extension formed by the inner end of the sleeve 60. A set screw 61 is threadably supported in the sleeve 60 and has an inner end portion adapted to engage the outer periphery of the inner end portion of the needle 23 to maintain the sleeve 60 in adjusted position. The sleeve 60 is provided with a conical tapering outer peripheral surface 62 on its end portion adjacent the inwardly tapering conical surface 16 on the inner end of the venturi 15. This conical tapering outer peripheral surface 62 tapers approximately five degrees relative to the axial center of the sleeve 60 and extends along a major portion of the outer periphery of the sleeve 60.

Figure 5:
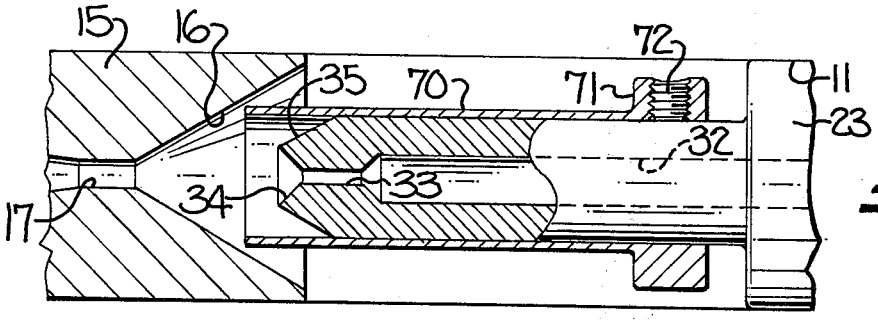
FIG. 5 is a view similar to FIGS. 3 and 4 but showing a third form of turbulence generator sleeve applied to the inner end of the needle.

The third type of turbulence generator sleeve, indicated at 70 in FIG. 5, has a straight inner end portion and is relatively thin and of uniform diameter throughout the major portion of its length. An enlarged collar 71 is provided at its end remote from the exit end of the needle 23 for threadably supporting an adjustment set screw 72.

Figure 6:
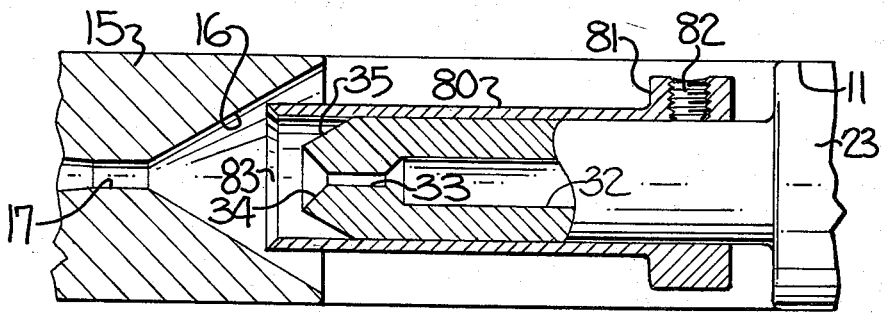
FIG. 6 is a view similar to FIGS. 3–5 but illustrating a fourth form of turbulence generator sleeve applied to the inner end of the needle.

The fourth type of turbulence generator sleeve, indicated at 80 in FIG. 6, also is relatively thin and of uniform diameter throughout the major portion of its length. An enlarged collar 81 is provided at the end of the sleeve 80 remote from the exit end of the needle 23 for threadably supporting a set screw 82. The inner end of the sleeve 80 includes an inner conical surface 83 tapering inwardly toward the exit end of the needle 23.

There appears to be very little, if any, difference in operation in any one of the turbulence generator sleeves illustrated in FIGS. 3–6 when they are applied to the inner end of the needle 23. Each of these sleeves provides a tubular extension projecting outwardly beyond the exit end of the needle 23 and each sleeve has an inner end portion which is positioned closely adjacent the inwardly tapering conical surface 16 on the inner end of the venturi 15 whereby the entrance end of the turbulence chamber is enlarged and is defined by the exit end of the needle 23 and the tubular extension on the inner end of the needle. Also, each of the types of sleeves shown in FIGS. 3–6 is provided with an inner diameter surrounding and conforming to the outer diameter of the inner end portion of the needle 23 and means is provided for adjustably supporting the sleeve on the inner end portion of the needle 23 for axial adjustment relative to the exit end of the needle.

In the drawings and specification, there have been set forth preferred embodiments of the invention, and although specific terms are employed, they are used in a generic and descriptive sense only and not for purposes of limitation, the scope of the invention being defined in the claims.

That which is claimed is:

1. In a yarn texturing air jet of the type including an elongate housing having a central bore therethrough, a venturi supported in the central bore and in the exit end of said housing, an inwardly tapering conical surface on the inner end of said venturi and terminating in an exit orifice extending through the exit end of said venturi, a yarn guiding needle positioned in the central bore of said housing and having an inner end portion defining an exit end of said needle, said needle having an axial yarn guiding channel extending therethrough for directing multifilament yarn through said needle and toward said venturi, said inwardly tapering conical surface of said venturi defining the exit end of a turbulence chamber, and means for directing pressurized gas into the central bore of said housing and along said inner end portion of said needle whereby the gas passes through said turbulence chamber and outwardly through said exit orifice of said venturi to impart crimps, curls and loops to the filaments as the yarn passes through said turbulence chamber, the combination therewith of means for improving the turbulence and enhancing the crimps, curls and loops imparted to the yarn passing through said turbulence chamber, said means comprising a tubular extension projecting outwardly beyond said exit end of said needle and having an inner end portion positioned closely adjacent said inwardly tapering conical surface on the inner end of said venturi whereby the entrance end of said turbulence chamber is defined by said exit end of said needle and said tubular extension on the inner end of said needle.

2. A yarn texturing air jet according to claim 1 wherein said tubular extension comprises a sleeve having an inner diameter surrounding and conforming to the outer diameter of said inner end portion of said needle, and means for adjustably supporting said sleeve on said inner end portion of said needle for axial adjustment relative to said exit end of said needle.

3. A yarn texturing air jet according to claim 2 wherein said adjustment means comprises a set screw threadably supported in said sleeve and having an inner end portion adapted to engage said inner end portion of said needle.

4. A yarn texturing air jet according to claim 2 wherein said sleeve is provided with a conical tapering outer peripheral surface on its end portion adjacent said inwardly tapering conical surface on the inner end of said venturi.

5. A yarn texturing air jet according to claim 4 wherein said conical outer peripheral surface of said sleeve tapers approximately 15 degrees relative to the axial center of said sleeve.

6. A yarn texturing air jet according to claim 4 wherein said conical outer peripheral surface of said sleeve tapers approximately 5 degrees relative to the axial center of said sleeve.

7. A yarn texturing air jet according to claim 3 wherein the inner end portion of said sleeve is relatively thin and of uniform diameter throughout the major portion of its length, and including an enlarged collar at the end of said sleeve remote from said exit end of said needle for supporting said set screw.

8. A yarn texturing air jet according to claim 7 wherein the inner end of said sleeve includes an inner conical surface tapering inwardly toward said exit end of said needle.

9. A yarn texturing air jet according to claim 1 wherein said exit end of said needle is provided with a conical opening extending from the inner end of said needle and inwardly toward the entrance end and terminating at the yarn guiding channel extending through said needle.

* * * * *